US005927569A

United States Patent [19]

Gottlieb

[11] Patent Number: 5,927,569

[45] Date of Patent: Jul. 27, 1999

[54] ONE PIECE FLEXIBLE PLASTIC CONTAINER WITH REINFORCED SUPPORT RING

[75] Inventor: Norman J. Gottlieb, Thornhill, Canada

[73] Assignee: Container Corporation International Inc., St. Michael, Barbados

[21] Appl. No.: 09/135,547

[22] Filed: Aug. 17, 1998

[51] Int. Cl.[6] ..... B67D 3/00

[52] U.S. Cl. ..... 222/529; 141/372

[58] Field of Search ..... 222/527, 529; 141/372; 215/395, 396, 398, 399

[56] References Cited

U.S. PATENT DOCUMENTS 2,954,901 10/1960 Winstead .
3,082,927 3/1963 Winstead .
3,353,924 11/1967 Birrell et al. ..... 222/92 X
5,170,910 12/1992 Hamm ..... 222/527 X
5,226,550 7/1993 Mikolaitis et al. ..... 215/396 X
5,301,725 4/1994 Meinzinger ..... 141/372
5,637,167 6/1997 Krishnakumar et al. ..... 156/85

*Primary Examiner*—Gregory L. Huson
*Attorney, Agent, or Firm*—Nancy E. Hill; Hill & Schumacher; Dowell & Dowell, P.C.

[57] ABSTRACT

A blow-molded container has a container portion, and an integrally molded pour spout and an integrally molded collar. The integrally molded pour spout extends outwardly from the container and has an open end portion. The integrally molded collar extends outwardly from the pour spout and is spaced from the container portion.

11 Claims, 5 Drawing Sheets

ONE PIECE FLEXIBLE PLASTIC CONTAINER WITH REINFORCED SUPPORT RING

FIELD OF THE INVENTION

This invention relates plastic containers and in particular plastic containers with reinforced neck ring.

BACKGROUND OF THE INVENTION

Plastic containers are well known and have been used in a variety of application for a number of years. One type of plastic container that is commonly used is a large box-like container. Improvements to design and manufacture of these containers have been the subject of a number of improvements by manufacturers.

For example U.S. Pat. No. 5,170,910 issued to Hamm on Dec. 15, 1992 shows a box-like container with a collapsible pour spout. The pour spout of this invention has a shoulder which is made of a plurality of concentric ridges and intervening webs. However, the ridges and webs are discontinuous. This design however cannot be easily adapted for use in a production line. There is clearly no place for filler tracks to engage the container and carry it through a production line.

Some prior art containers have attempted to address the above problem with regard to a production line by welding a collar to the pour spout. These containers have four components, namely a high density neck, a low density collar, a high density flange and a container or bag. The flange and neck are made from an injection molded high density polyethylene. The low density collar is pressure welded between the two high density components namely the neck and flange. The high density flange and neck is produced in a vacuum formed process. Thereafter the neck is secured to the bag or container.

There are a number of disadvantages of this container which is made of four components. Specifically, the components do not have similar melt or stretch ratios, that is, the high density components have different molecular weight from the low density molecular weight of the bag. Therefore, there is a tendency to have differentials on cooling or heating, causing microscopic fissures that contribute to leaking particularly with high surface tension fluids. Another disadvantage of the four component container is the tendency for the weld between the flange and the bag to be unreliable owing to the fact that they are two dissimilar pieces joined mechanically. This has led to the need to create a gasket film on the lip of the neck made form toluene, to compensate for possible fissures or hairline cracks created by the stretching and/or cooling or heating differentials between the two dissimilar polyolefins. Another disadvantage is that the container or bag is manufactured by heat welding of two vacuum formed halves whereby there may be possible inaccuracies in bonding or plastic distribution and therefore there may be possible further hairline cracks.

Other prior art containers such as those shown in related U.S. Pat. Nos. 2,950,029 issued to Winstead on Aug. 23, 1960, 2,954,901 issued to Winstead on Oct. 4, 1960, and 3,082,927 issued to Winstead on Mar. 26, 1963 are generally cube-shaped containers with a pour spout extending outwardly from one edge thereof. The container is made from two symmetrical halves which are sealed together by heat sealing. Optionally the cube-shaped container is provided with an outer carton. As another option the container may be lined. This container has similar disadvantages as those described above. This container is made of two halves that are sealed together and the seal is subject to cracking. Further, there is nothing suggested in the patents regarding providing a reinforced collar which can support the weight of the container when it is being filled.

Accordingly it would be advantageous to provide a container that is made of one piece of material. Further it would be advantageous to provide a container that has a collar which can support the weight of the container during filling made from the same material at the same time.

A blow-molded container has a container portion, an integrally molded pour spout, an integrally molded shoulder portion and an integrally molded collar. The integrally molded pour spout extends outwardly from the container and has an open end portion and an axial direction. The integrally molded shoulder portion extends outwardly in the axial direction and inwardly in the lateral direction from the container portion to the pour spout. The integrally molded collar extends laterally from the pour spout and is spaced from the container portion and the lateral dimension of the molded collar is generally equal to the lateral dimension of the shoulder portion. Preferably the collar is reinforced so that reinforced collar can hold the weight of the container during an automated filling process.

Further features of the invention will be described or will become apparent in the course of the following detailed description.

BRIEF DESCRIPTION OF THE DRAWINGS

The invention will now be described by way of example only, with reference to the accompanying drawings, in which.

DETAILED DESCRIPTION OF THE INVENTION

Figure 1:
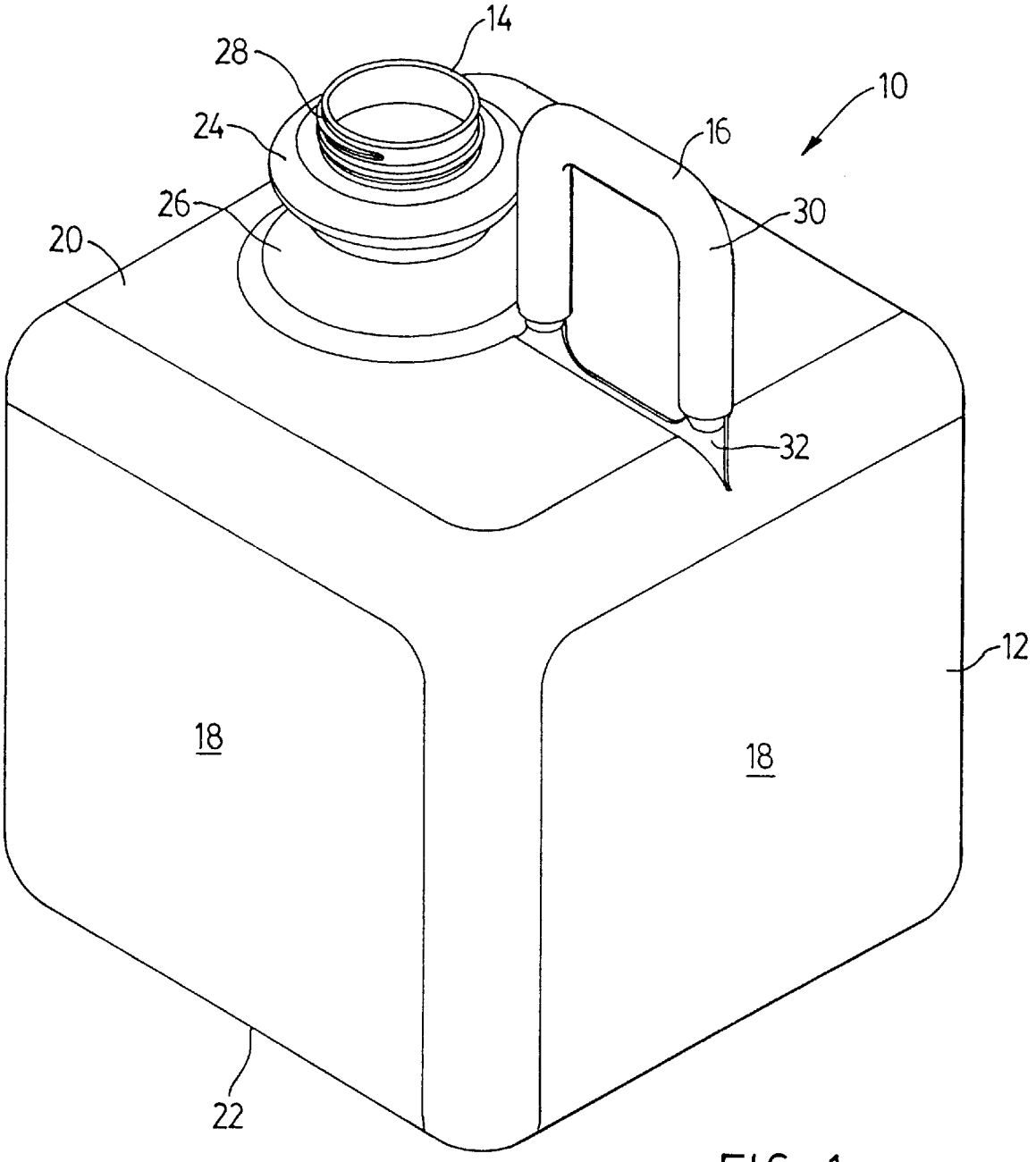
FIG. 1 is a perspective view of a container constructed in accordance with the present invention.
Figure 2:
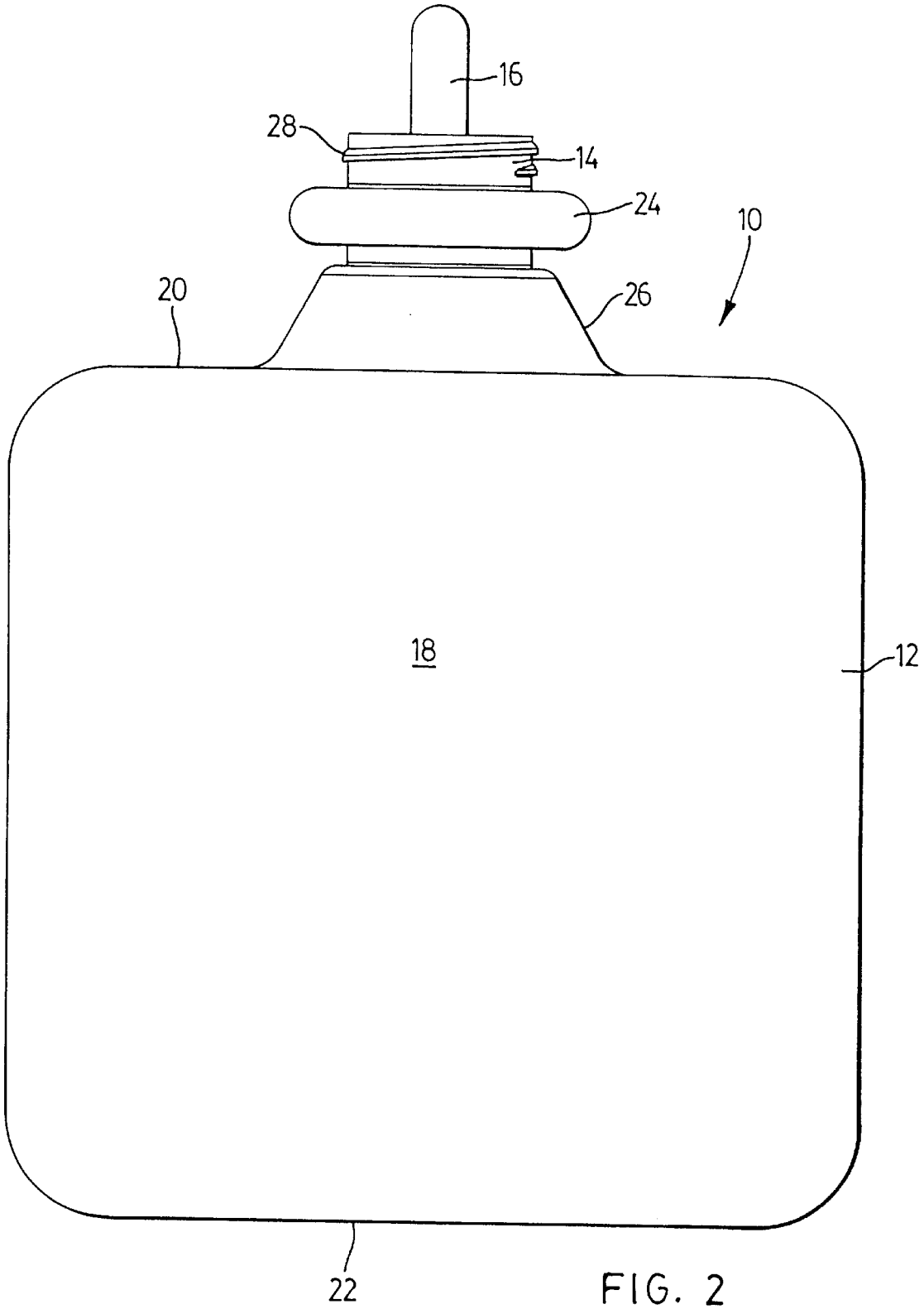
FIG. 2 is a side view of the container.
Figure 3:
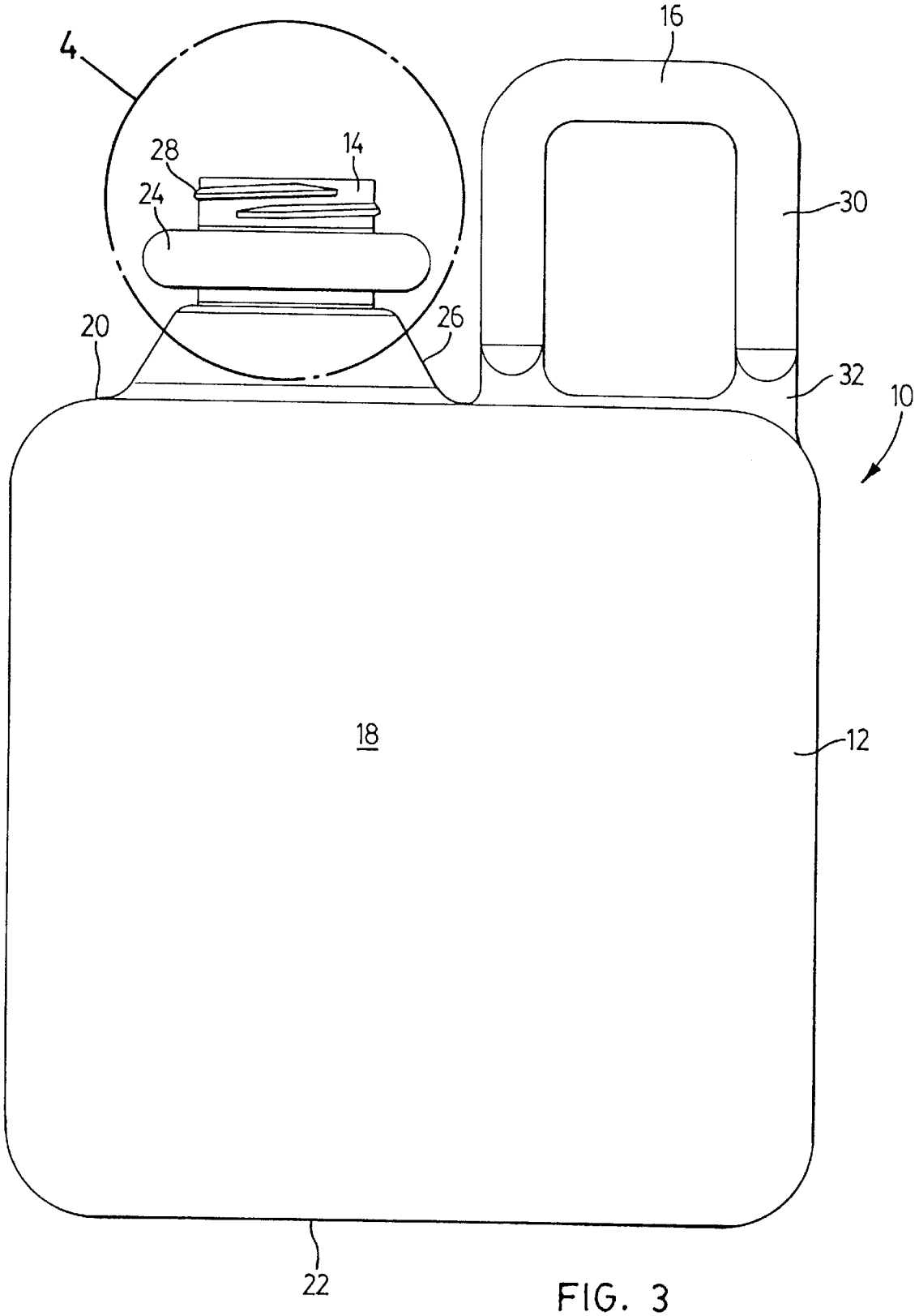
FIG. 3 is a side view of the container with the container rotated 90° from the orientation shown in FIG. 2.
Figure 4:
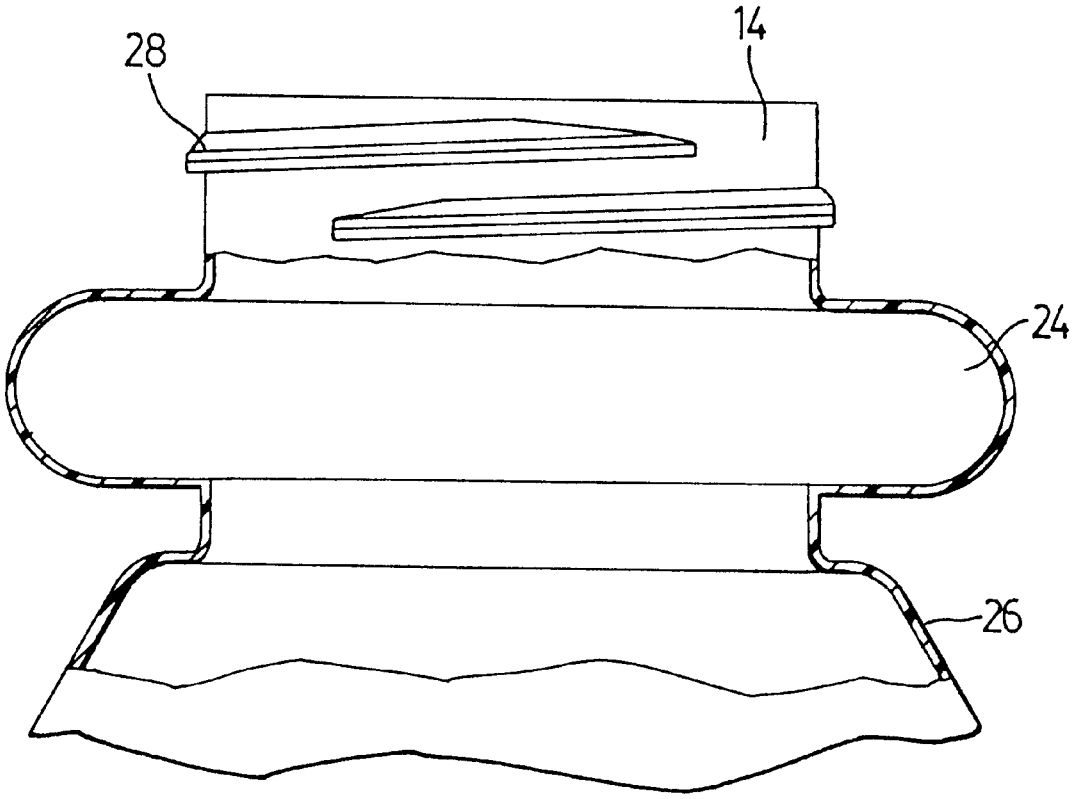
FIG. 4 is an enlarged side view with a portion broken away of a portion of the container showing a pour spout, a collar and a portion of the shoulder of the container of the present invention as shown in FIG. 3.

Referring to FIGS. 1, 2 and 3, the container of the present invention is shown generally at 10. The container includes a container portion 12, a pour spout 14 and a handle 16. Container portion 12 has four side panels 18, a top 20 and a bottom 22.

A collar 24 is integrally molded as part of container 10 and is positioned below and extends outwardly from pour spout 14. Collar 24 extends outwardly from the pour spout 14 and is spaced from the container portion 12. Collar 24 is thicker material than the remainder of the container 10 thereby collar 24 is reinforced. Collar 24 is dimensioned so that the collar can rest on two filler tracks in a production line. Further the collar is sized and reinforced so that it can hold the weight of a filled container during the filling process.

Figure 5:
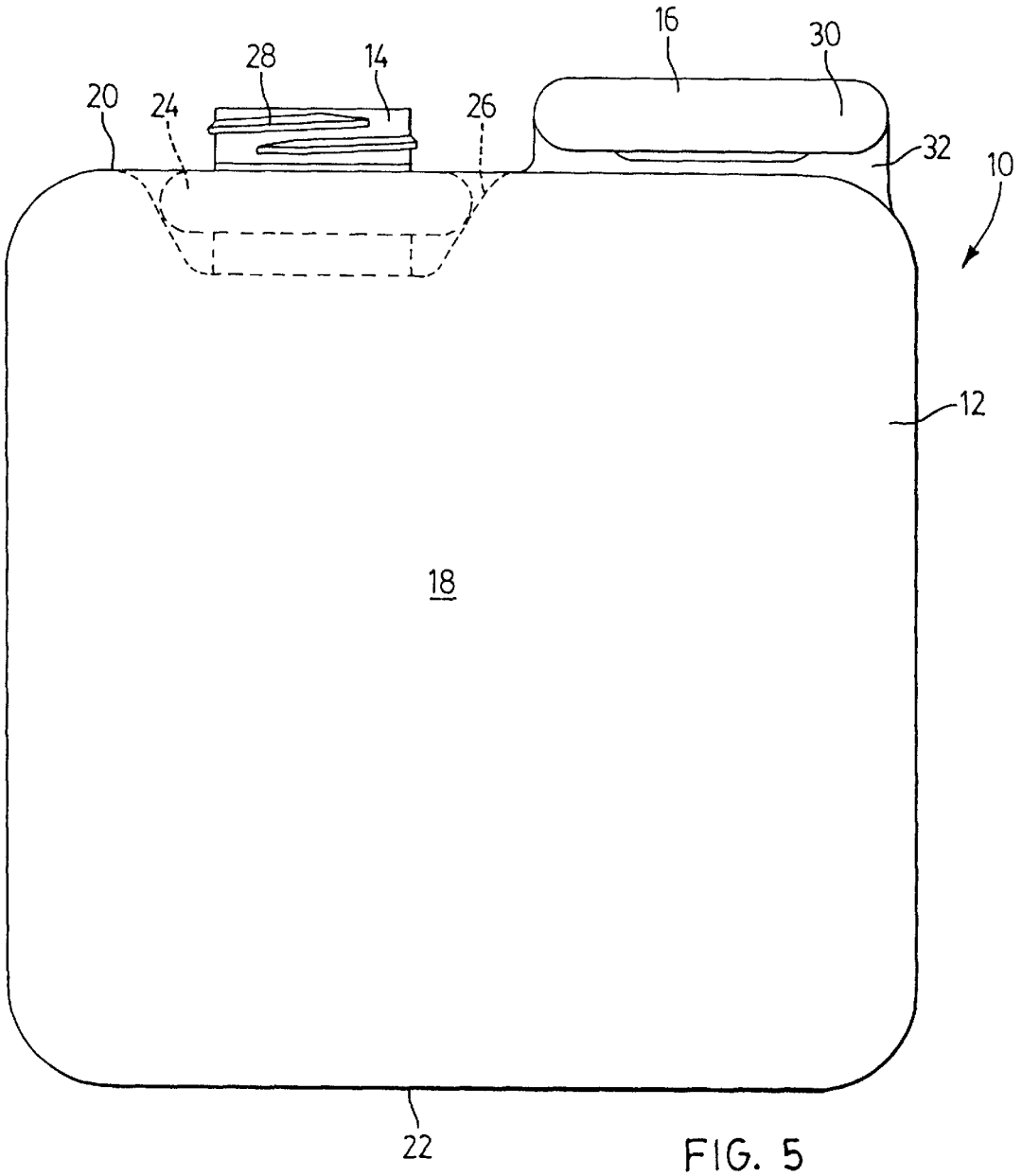
FIG. 5 is a side view similar to FIG. 3 wherein the pour spout in a retracted position and the handle in a stored position.

A collapsible shoulder 26 extends below the collar 24 and integrally attaches the pour spout 14 to the container portion 12. Shoulder 26 is generally frusto-conical in shape. Shoulder 26 has an extended position shown in FIGS. 1, 2 and 3 and a retracted or collapsed position shown in FIG. 5.

Pour spout 14 has a threaded portion 28 for receiving a cap (not shown). Handle 16 has a grip portion 30 and a connecting portion 32. Connecting portion 32 is thin so that handle 16 can easily be pushed into a stored position wherein it is against the top 20 of the container 10. This is of particular use during storage and shipping.

Container 10 is manufactured using blow molding techniques. Container 10 is integrally molded in one piece. Preferably container 10 is manufactured from polyolefin. Because container 10 is one piece and made of a flexible material such as polyolefin, the tendency to experience crazing or fissures or any other aperture which could cause leaking in the neck area caused from attachments of other components is reduced.

It will be appreciated that the above description related to one embodiment by way of example only. Many variations on the invention will be obvious to those skilled in the art and such obvious variations are within the scope of the invention as described herein whether or not expressly described.

What is claimed as the invention is:

1. A blow-molded container comprising:

a container portion;

an integrally molded pour spout extending outwardly from the container having an open end portion and an axial direction;

an integrally molded shoulder portion extending outwardly in the axial direction and inwardly in the lateral direction from the container portion to the pour spout;

an integrally molded collar extending laterally from the pour spout and spaced from the container portion and the lateral dimension of the molded collar is generally equal to the lateral dimension of the shoulder portion.

2. A blow-molded container as claimed in claim 1 wherein the collar is reinforced and wherein the reinforced collar can support the weight of the container during the filling process.

3. A blow-molded container as claimed in claim 2 wherein the pour spout has a threaded portion for receiving a cap and the threaded portion is at the open end portion and spaced from the collar.

4. A blow-molded container as claimed in claim 3 wherein the pour spout is retractable.

5. A blow-molded container as claimed in claim 4 wherein the shoulder portion is collapsible and has a generally frusto-conical shape.

6. A blow-molded container as claimed in claim 4 wherein the container portion is generally cube shaped having a top, a bottom and sides and wherein the pour spout extends upwardly from the top.

7. A blow-molded container as claimed in claim 5 further including a handle extending upwardly from the top of the container portion.

8. A blow-molded container as claimed in claim 1 wherein the pour spout has a threaded portion for receiving a cap and the threaded portion is at the open end portion and spaced from the collar.

9. A blow-molded container as claimed in claim 1 wherein the pour spout is retractable.

10. A blow-molded container as claimed in claim 1 wherein the container portion is generally cube shaped having a top, a bottom and sides and wherein the pour spout extends upwardly from the top.

11. A blow-molded container as claimed in claim 1 further including a handle extending upwardly from the top of the container portion.

* * * * *

UNITED STATES PATENT AND TRADEMARK OFFICE

CERTIFICATE OF CORRECTION

PATENT NO. : 5,927,569

DATED : 7/27/99

INVENTOR(S) : Gottlieb

It is certified that error appears in the above-identified patent and that said Letters Patent is hereby corrected as shown below:

On the title page item [54], change title to read as follows:

--ONE PIECE FLEXIBLE PLASTIC CONTAINER WITH REINFORCED SUPPORT NECK RING--.

Signed and Sealed this

Fifth Day of September, 2000

*Attest:*

*Attesting Officer*

Q. TODD DICKINSON

*Director of Patents and Trademarks*